US008997977B2

(12) United States Patent
Potterfield et al.

(10) Patent No.: US 8,997,977 B2
(45) Date of Patent: Apr. 7, 2015

(54) AMMUNITION STORAGE CONTAINER

(75) Inventors: Russell A. Potterfield, Columbia, MO (US); Adam Birk, Lohman, MO (US); Jim Gianladis, Columbia, MO (US); Robert J. Zara, Rocheport, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 12/964,474

(22) Filed: Dec. 9, 2010

(65) Prior Publication Data

US 2011/0233076 A1 Sep. 29, 2011

Related U.S. Application Data

(60) Provisional application No. 61/285,128, filed on Dec. 9, 2009.

(51) Int. Cl.

| | |
|---|---|
| ***F42B 39/00*** | (2006.01) |
| ***B65D 81/05*** | (2006.01) |
| ***B65D 21/02*** | (2006.01) |
| ***B65D 43/02*** | (2006.01) |
| ***F42B 39/26*** | (2006.01) |

(52) U.S. Cl.

CPC ..... *B65D 81/05* (2013.01); *B65D 21/0219* (2013.01); *B65D 43/0212* (2013.01); *B65D 2543/00194* (2013.01); *B65D 2543/0025* (2013.01); *B65D 2543/00296* (2013.01); *B65D 2543/00527* (2013.01); *B65D 2543/00537* (2013.01); *B65D 2543/00629* (2013.01); *B65D 2543/00675* (2013.01); *B65D 2543/0074* (2013.01); *B65D 2543/00787* (2013.01); *B65D 2543/00888* (2013.01); *B65D 2543/00925* (2013.01); *F42B 39/26* (2013.01)

(58) Field of Classification Search

CPC ..... F42B 39/22; F42B 39/26

USPC ..... 206/3, 96, 119, 262, 249, 254, 276, 1.5; 42/87–90; 217/18; 224/196; 49/186, 49/281, 286; 70/1.7, 10, 51, 59, 145; 135/33.41, 904, 33.4; 150/131, 150; 220/547, 203.13, 780, 8, 23.89; 292/102, 106, 204, 205, 302, 303, 292/593.11, 35, 80, 81, 86, 87, 89, 304, 292/DIG. 38; 24/273, 442, 583.11, 607, 24/270, DIG. 43, DIG. 44, 591.1; 215/201, 215/217, 235, 238, 239, 242, 245, 284

See application file for complete search history.

(56) References Cited

U.S. PATENT DOCUMENTS

| | | | | | |
|---|---|---|---|---|---|
| 3,593,873 | A | * | 7/1971 | Vonk | 220/507 |
| 4,387,805 | A | * | 6/1983 | Lanius | 206/230 |
| 4,757,894 | A | * | 7/1988 | Schreckenstein | 206/3 |
| 4,942,991 | A | * | 7/1990 | Lyons | 224/196 |
| 4,951,692 | A | * | 8/1990 | Yuhara et al. | 132/293 |
| 5,577,779 | A | * | 11/1996 | Dangel | 292/80 |

(Continued)

*Primary Examiner* — Luan K Bui
*Assistant Examiner* — Rafael Ortiz
(74) *Attorney, Agent, or Firm* — Senniger Powers LLP

(57) ABSTRACT

An apparatus for storing ammunition. The apparatus is comprised of a first member and a second member. The first member has an interior portion. The second member is configured so that at least a portion of the second member may enter the interior portion of the first member. The first member includes a first element of a securing device and the second member includes a second element of the securing device. The securing device releasably secures the first and second members together.

22 Claims, 6 Drawing Sheets

(56) References Cited

U.S. PATENT DOCUMENTS

| | | | | |
|---|---|---|---|---|
| 5,725,123 | A * | 3/1998 | Otto-Nagels | 220/796 |
| 5,829,591 | A * | 11/1998 | Lyons | 206/373 |
| 6,620,384 | B2 * | 9/2003 | Copelan | 422/561 |
| 7,395,922 | B1 * | 7/2008 | Sinha | 206/3 |
| 2004/0195241 | A1 * | 10/2004 | Stull et al. | 220/326 |
| 2008/0000781 | A1 * | 1/2008 | Noel Du Payrat et al. | 206/3 |
| 2008/0264815 | A1 * | 10/2008 | Allen | 206/315.11 |
| 2009/0045078 | A1 * | 2/2009 | Gelardi et al. | 206/1.5 |

* cited by examiner

AMMUNITION STORAGE CONTAINER

CROSS-REFERENCE TO RELATED APPLICATION(S)

The present application claims priority to and the benefit of U.S. Provisional Application No. 61/285,128, filed Dec. 9, 2009.

TECHNICAL FIELD

The present disclosure is directed to containers for carrying firearm ammunition and more specifically, a portable ammunition container with a securing device.

BACKGROUND

Ammunition must be stored properly so that it is not scratched or dinged. If damaged, it can harm a firearm that it is shot from and it may curve unpredictably during flight, decreasing the accuracy of the shot. If rounds or bullets are placed in a container, like a pouch or box, and allowed to move freely, they may damage each other or be damaged by the container when they are transported. To avoid damage, ammunition can be stored so that rounds or bullets are confined relative to each other. However, ammunition storage containers that are able to secure ammunition in this way also make retrieving the ammunition more cumbersome.

DETAILED DESCRIPTION

Figure 1:
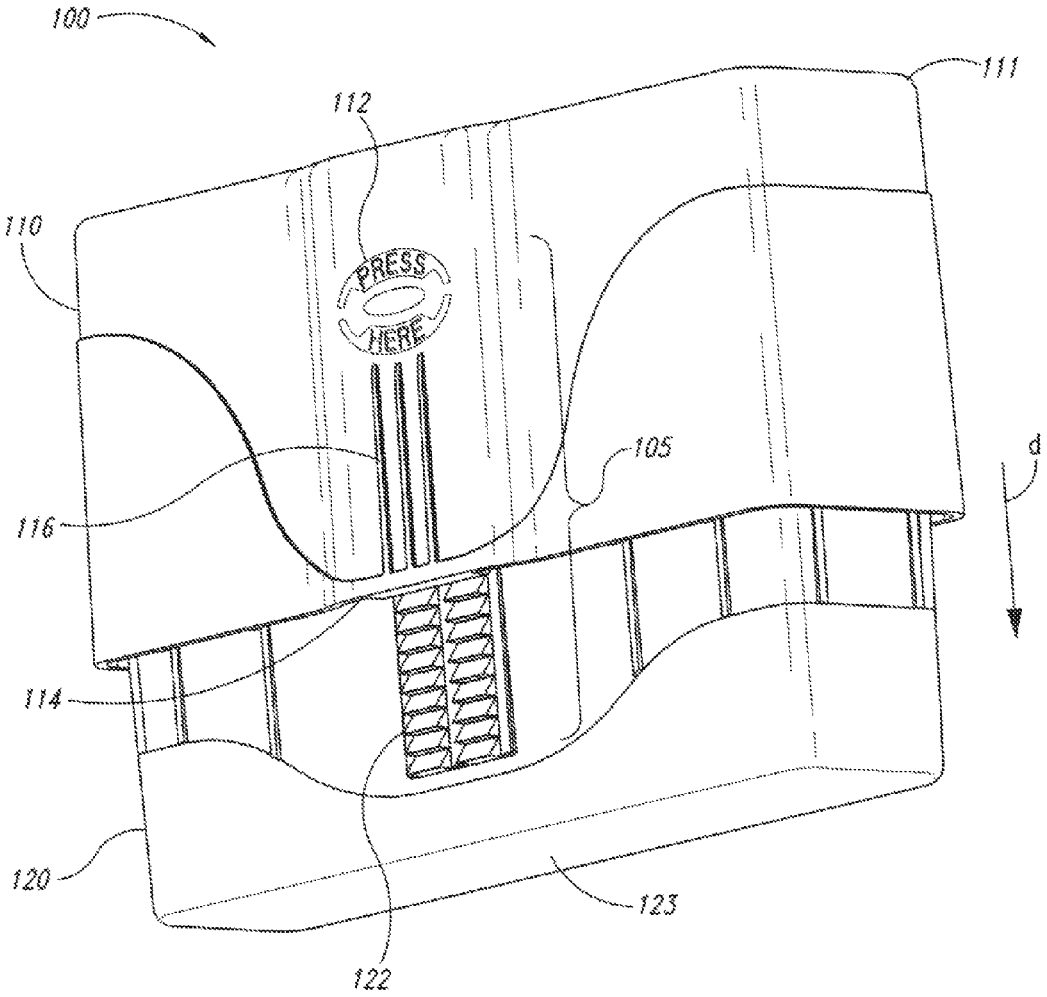
FIG. 1 is an isometric view of an ammunition storage container.

A storage container is described herein. The storage container is comprised of a first member and a second member. The storage container includes at least one securing device that releasably secures the two members together. The first and second members each have interior portions. The second member is configured to enter the interior portion of the first member. A first element of the securing device is configured on the first member and a second element of the securing device is configured on the second member. The securing device is configured to releasably secure the first member to the second member when the first member is slid over the second member. In some embodiments, the securing device automatically secures the first member with the second member when the first member is slid over the second member.

In some embodiments, the storage device is configured to store ammunition (e.g., a shell, a round, a bullet, etc.). The second member may include a plurality of slots configured to compartmentalize the ammunition. In alternative embodiments, the interior portion of the second member includes a plurality of slots of varying sizes, for example, for use with ammunition shells of various size or caliber. In some embodiments, the interior portion of the second member includes a cavity. In certain embodiments, the interior portion of the second member includes a plurality of slots that include a damper and/or a damper frame. The slots may be defined by dividers that completely separate the contents of the slots. In some embodiments, the slots are defined by a frame that does not extend the height of the second member.

In some embodiments, the securing device includes a lever, an engagement component and a reciprocal engagement component. According to aspects of the disclosure, the engagement component may include a catch, a hook, a groove, a detent, a protrusion or other suitable retaining elements, and the reciprocal engagement component can include a reciprocally sized groove, indent, detent, notch or the like for receiving, retaining, or otherwise engaging the engagement component. According to one embodiment, the engagement component is a catch and the reciprocal engagement element is a catch engagement component; however, as one skilled in the art will understand, other combinations can be substituted for a catch and a reciprocal catch engagement component and be within the scope of the disclosure. According to this embodiment, the catch and the lever can be configured on the first member and the catch engagement component can be configured on the second member. In certain embodiments, the catch engagement component can be a set of teeth or a set of holes, or just one tooth or one hole. According to aspects of the disclosure, the securing device may secure the first member and the second member at varying heights of the container. The first member can include a pressure point which releases the catch from the catch engagement component.

Various embodiments of the method and system will now be described. The following description provides specific details for a thorough understanding and enabling description of these embodiments. One skilled in the art will understand, however, that the method and system may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the method and system. Certain terms may even be emphasized below; however, any terminology intended to be interpreted in any restricted manner will be overtly and specifically defined as such in this Detailed Description.

FIG. 1 is an isometric view of an ammunition storage container 100. The ammunition storage container 100 includes a first member 110 and a second member 120. A securing device 105 releasably secures the first member 110 and the second member 120 together. The first member 110 includes an interior portion, which may receive a top portion of the second member 120 when the first member 110 is secured to the second member 120. In some embodiments, the second member 120 is tapered toward a base 123 and the base 123 is configured to fit on a top 111 of the first member 110 so that multiple ammunition storage containers 100 may be stacked upon each other. As is shown in later figures, the top 111 may include a lip or ridge in which the base 123 of the second member 120 sits to prevent an ammunition storage container 100 from falling off another. According to further aspects of the disclosure, the corners of the ammunition storage container can be rounded and coated with a soft material, such as rubber, to cushion the ammunition storage container 100 in a fall.

The securing device 105 includes a portion located on the first member 110 (i.e., a first element) and a portion located on the second member 120 (i.e., a second element). In some embodiments, the securing device includes a lever, an engagement component and a reciprocal engagement component. According to aspects of the disclosure, the engagement component may include a catch, a hook, a groove, a detent, a protrusion or other suitable retaining elements, and the reciprocal engagement element can include a reciprocally sized groove, indent, detent, notch or the like for receiving and/or retaining the engagement component. As shown with reference to FIG. 1, the securing device 105 is a ratchet device consisting of a catch 114 configured on the first member 110 and a reciprocal engagement component for the catch configured as a set of teeth 122 on the second member 120, however, one skilled in the art will understand that alternative securing device may be substituted for the ratchet configuration and remain within the scope of the disclosure. According to this embodiment, the catch 114 is configured on the inside of the first member 110 and the set of teeth 122 is configured on the outside of the second member so that the catch 110 and the set of teeth 122 align and face one another when the first member 110 is placed on top of the second member 120. In some embodiments, the first member includes a catch engagement component and the second member includes a catch.

In operation, when the first member 110 is placed over the second member 120 and moved relative to the second member in the direction of a line 'd,' the catch 114 of the first member 110 may slide over the set of teeth 122 of the second member 120. After the catch 114 moves past a first tooth of the set of teeth 122, and the first member is moved in the direction opposite line 'd,' the catch 114 automatically engages with the set of teeth 122. When the catch 114 is engaged with the set of teeth 122, the first member is prevented from moving relative to the second member 120 in the direction opposite line 'd.' Thus, the first member is automatically releasably secured to the second member when it is placed over the second member and pushed toward the second member beyond an engagement point (e.g., beyond the first tooth of the set of teeth 122). If free from obstruction, such as from ammunition placed inside the storage container 100 that is longer than the height of the second member 120, the first member 110 may be moved relative to the second member 120 past a final tooth of the set of teeth 122. In some embodiments, a securing device does not automatically secure first and second members of the ammunition storage container when the members are pushed together. Rather, a user must manually secure the members together using the securing device. For example, the reciprocal engagement element may be a hole and the engagement element may be a plug. The plug may be pushed into the hole to secure the first member with the second member.

After the catch 114 has engaged the set of teeth 122, the first and second members are secured together until the catch 114 is released from the set of teeth 122. As is explained in further detail below, a pressure point 112 on the first member 110 is associated with a lever 116, and the lever is associated with the catch 114. Exerting pressure on the pressure point 112 releases the catch 114 from the set of teeth 122. With pressure exerted on the pressure point 112, the first member 110 may be moved relative to the second member 120 in the direction opposite line 'd' without the catch 114 engaging the set of teeth 122.

In some embodiments, such as those that are depicted with respect to later figures, the ammunition storage container includes more than one securing device. In embodiments in which the storage container includes two securing devices, the securing devices may be configured on opposite sides of the ammunition storage container. For example, a second pressure point, a second lever, a second catch, and a second set of teeth may be configured on a side of the ammunition storage container opposite a first pressure point, a first lever, a first catch, and a first set of teeth. In accordance with this embodiment, this symmetry allows the first member to slide evenly onto the second member and provides convenient locations that pressure can be applied simultaneously to in order to release the securing devices.

Figure 2:
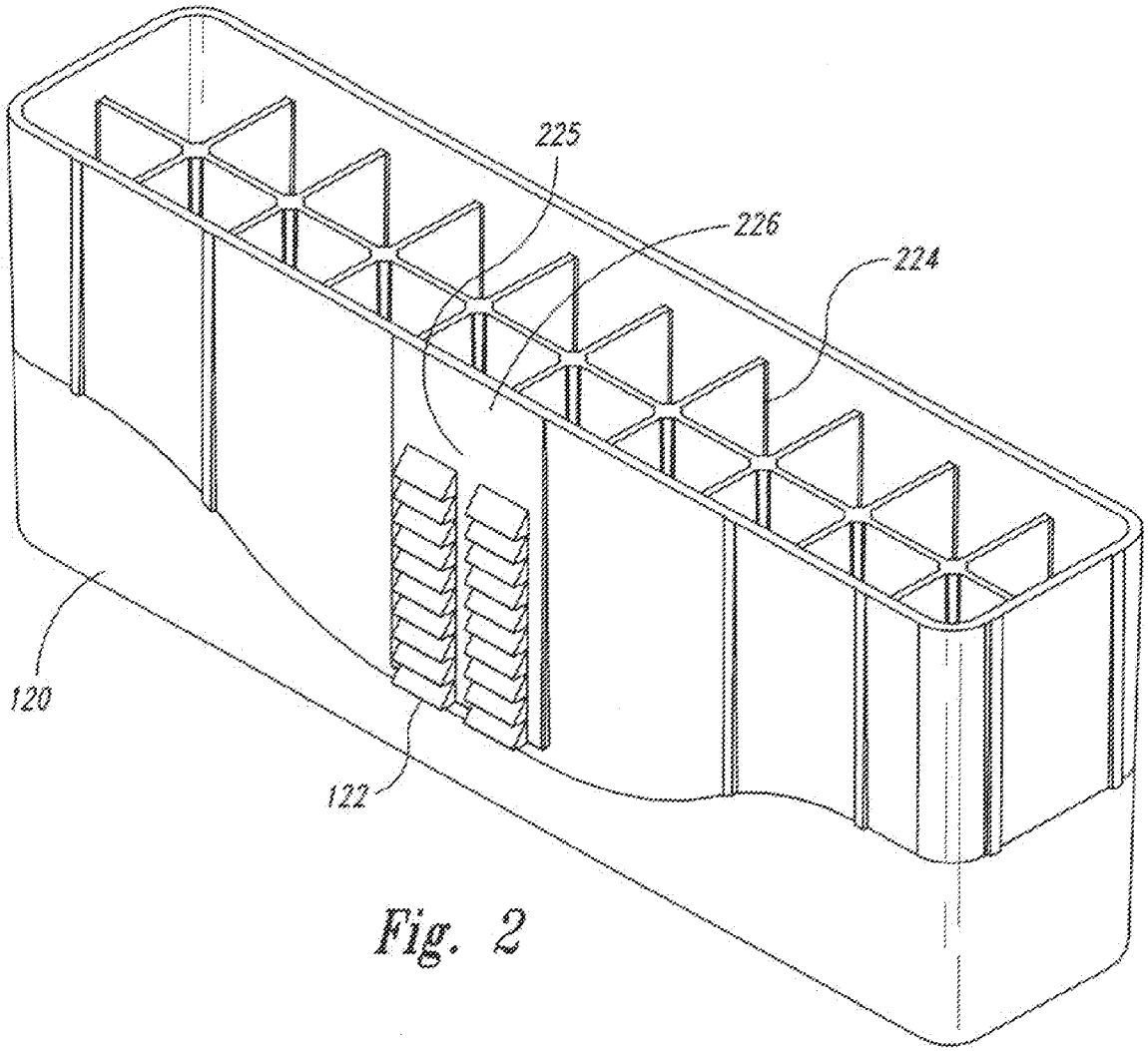
FIG. 2 is an isometric view of a second member of an ammunition storage container.

FIG. 2 is an isometric view of the second member 120 of the ammunition storage container 100. In some embodiments, the second member is constructed with a material capable of resisting external pressure without bending, cracking, or otherwise deforming. For example, the second member may be constructed with a hard plastic, a wood, or a hard metal.

The second member includes a plurality of slots 224, each of which may hold ammunition (e.g., a shell, a round, a bullet, etc.). The plurality of slots 224 compartmentalizes stored ammunition. Each of the plurality of slots 224 are square-shaped and extend substantially the entire height of the second member. However, in some embodiments, such as those depicted in later figures, some or all of the plurality of slots are another shape, such as a circle or a triangle. Additionally, in some embodiments, slots do not extend the entire height of the second member. For example, as detailed below, each of the plurality of slots may include a damper to cushion ammunition placed in the slots. The dampers may comprise a portion of the slots' volumes. Similarly, the slots may be configured so that they do not completely prevent their contents from contacting one another. For example, in some embodiments, the slots are not framed the entire height of the member, but rather are defined by dividers that frame only a top portion of each slot. Similarly, the slots may be defined by vertical poles configured to align ammunition in a pattern as it is placed in the second member. In some embodiments, a second member is configured as a solid block of material with slots defined by holes configured in the solid block.

As mentioned above, the second member can be configured to hold any of a number of different objects, including ammunition. The second member can be configured to hold any size of ammunition. For example, the height of the second member 120 may be reduced to hold shorter rounds or bullets (and the corresponding first member may be configured accordingly). Similarly, the length and width of the second member 120 may be increased or decreased depending on the caliber of projectile that is to be stored in the storage container (and the first member may be configured accordingly).

The set of teeth 122 is configured on the second member 120 below a lever pressure area 226 and includes a lever space 225. The lever pressure area 226 and the lever space 225 may be constructed with a material that provides high resistance to external pressure but little friction against the lever of the first member. For example, the lever pressure area 226 and lever space 225 may be constructed with a hard plastic, a wood, a hard metal, or the like. The lever space 225 is configured to receive a raised portion of the lever 116. As is described in more detail below, when pressure is exerted on the pressure point 112 of the first member to release the catch 114 from the set of teeth 122, a fulcrum of the lever 116 is created where a portion of the lever contacts the lever pressure area 226, lever space 225, and/or another area of the second member, releasing the catch from the set of teeth 122.

Figure 3:
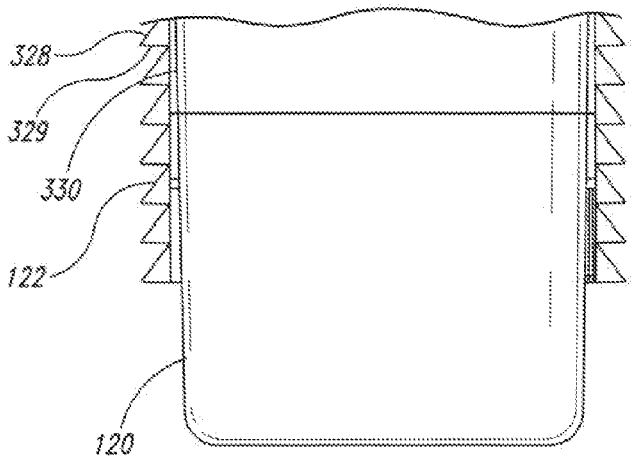
FIG. 3 is an exploded side view of a second member of an ammunition storage container.

FIG. 3 is an exploded side view of the second member 120 of the ammunition storage container 100. The set of, teeth 122 includes multiple teeth and is constructed with a material that provides both high resistance to external pressure, preventing the teeth from denting or otherwise deforming when the catch 114 of the first member 110 slides over the set of teeth 122, and little friction against the catch 114 of the first member, allowing the catch 114 to slide over the teeth. For example, the set of teeth 122 may be constructed with a hard plastic, a wood, or a metal. In some embodiments, each tooth of a set of teeth is configured having a hinge so that a tooth is pushed into the second member when the catch of the first member slides over the tooth in an initial direction, but the tooth recoils once the catch moves past the tooth, allowing the tooth to engage the catch if the catch moves relative to the tooth in a direction opposite the initial direction. In some embodiments, each tooth is constructed with a material that deforms when the catch of the first member slides over the tooth in an initial direction, but reforms and engages the catch when the catch moves relative to the tooth in a direction opposite the initial direction. Viewed from a side of the second member 120, each tooth is shaped as a right triangle. In some embodiments, the teeth are not shaped like right triangles. For example, the teeth may be circular or a hypotenuse of the plurality of teeth may be curved.

Figure 4A:
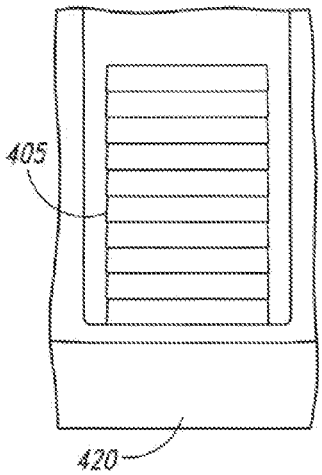
FIGS. 4A-E are front views of elements of securing devices for ammunition storage containers.
Figure 4B:
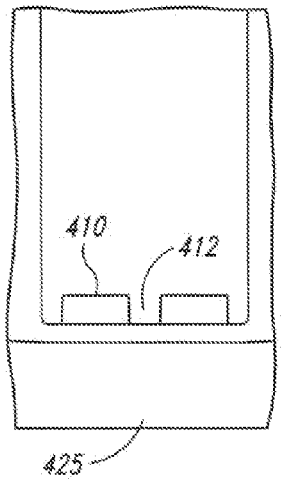

FIGS. 4A-E show elements of securing devices for storage containers. FIG. 4A is a front view of a reciprocal engagement component of a second member that is comprised of a set of teeth 405 that an engagement component, like a catch, of a first member of an ammunition storage container may engage with to secure the first member with the second member 420. The set of teeth 405 of the first member does not include a lever space like the set of teeth depicted in FIG. 2. FIG. 4B shows a reciprocal engagement component of a second member consisting of one row 410 of teeth. Because the second member 425 only includes one row of teeth 410, the first member can only be secured at one height on the second member 425. The row of teeth 410 includes a lever space 412.

Figure 4C:
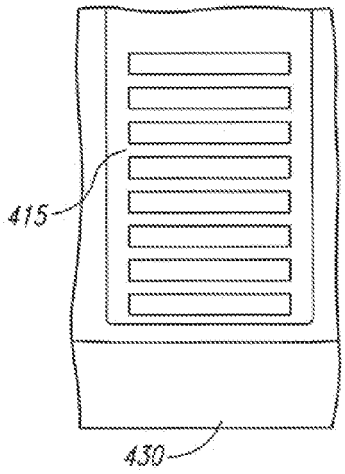

FIG. 4C is a front view of a reciprocal engagement component of a second member 430 that includes a set of holes 415 that an engagement component, like a catch, of a first member may engage with to secure the first member with the second member 430. The set of holes 415 may be detents in the second member, holes through the walls of the second member, notches, or the like. The engagement component of the first member may slide into a hole and out of it as the first member slides over the second member 430. However, when the first member is removed from the second member 430, the engagement component of the first member may enter a hole and engage the hole, preventing the first member from sliding off the second member 430.

Figure 4D:
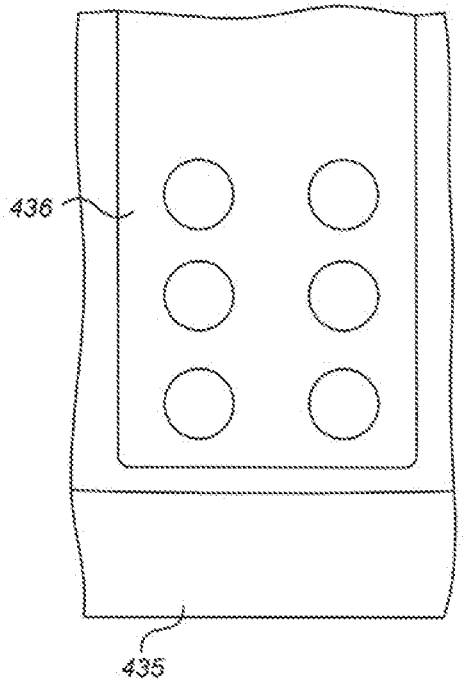
Figure 4E:
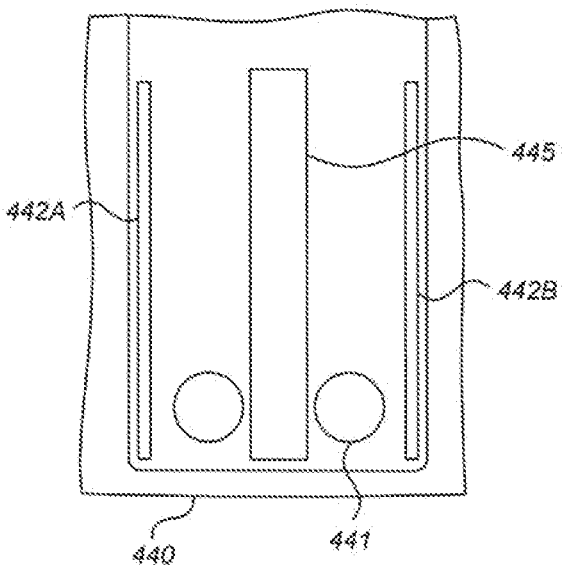

FIG. 4D is a front view of a reciprocal engagement component of a second member 435 that includes a set of holes 415 according to another embodiment. FIG. 4D is an front view of an engagement component of an inside portion of a first member 440 that includes a row of pegs 441 that may enter the set of holes 415 to secure the first member 440 to the second member 435. The engagement component includes a first outer detent 442A, a second outer detent 442B and a center detent 445, which, as explained in more detail below, may be configured to act as a fulcrum when the engagement component is released from the reciprocal engagement component.

Figure 5:
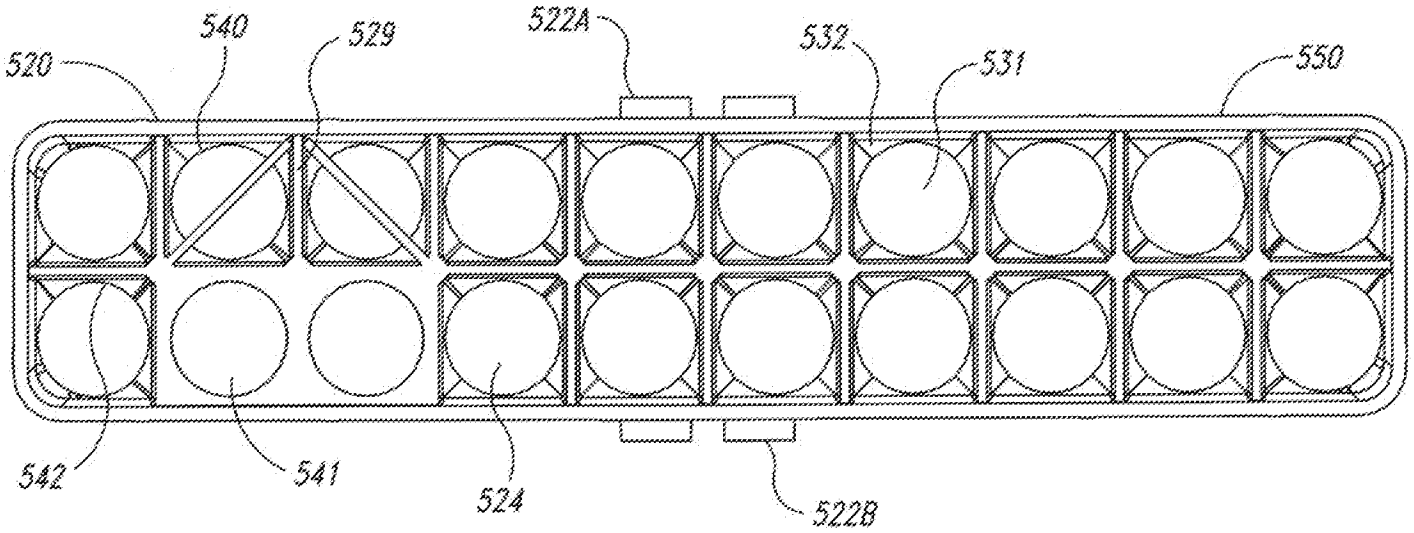
FIG. 5 is a top view of a second member of an ammunition storage container.

FIG. 5 is a top view of a second member 520 of an ammunition storage container. The second member 520 includes a first set of teeth 522A and a second set of teeth 522B. The first set of teeth 522A and the second set of teeth 522B are centered between the ends of second member 520. The second member includes a plurality of ammunition slots 524. Each of the ammunition slots includes a damper 531 constructed at the bottom of each of the ammunition slots 524. The dampers 531 are constructed with a material that provides padding for stored ammunition. The material of the dampers 531 may also prevent stored ammunition from moving within each of the plurality of ammunition slots 524. For example, the dampers 531 may be composed of a soft rubber or a foam. The dampers 531 may pad stored ammunition and/or provide friction against the stored ammunition to prevent the stored ammunition from moving within the ammunition slots 524. In some embodiments, the dampers 531 are circular, while in other embodiments, the dampers are another shape, such as a square. In some embodiments, the second member 520 is constructed of a hard material, such as a plastic, metal, or wood, and a base of the second member 520 is coated with a soft material suitable for use as a damper. A hole may be cut in the hard material at a base of the second member to reveal the coating of soft material.

In some embodiments, a damper frame 532 is located toward the bottom of each of the ammunition slots and surrounds the each of the dampers 531. The damper frame 532 may guide ammunition into the center of the ammunition slots and provide padding and friction to prevent the stored ammunition from moving or rattling within the ammunition slots 524.

In some embodiments, ammunition slots of a second member are uniform in size and shape. In other embodiments, slots are not uniform throughout the second member. Slots may be any shape, such as a square 542, a triangle 540, and a circle 541. They may be partitioned with dividers 529. Dividers 529 may vary in height throughout the second member or they may be a uniform height. As mentioned above, the dividers need not extend the height of the second member. For example, dividers may be comprised of a frame located at the top of the second member. In some embodiments, a gasket 550 is formed on the top of the second member to prevent moisture or air from entering the storage container. In some embodiments, a gasket is place elsewhere, such as on the first member.

Figure 6:
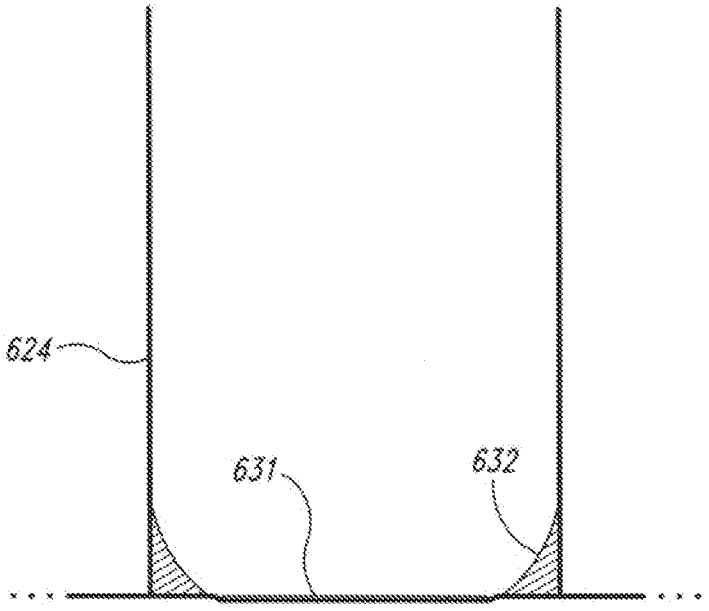
FIG. 6 is a cross-sectional side view of an ammunition slot of a second member of an ammunition storage container.

FIG. 6 shows a cross-sectional side view of an ammunition slot 624. The ammunition slot 624 includes a damper 631 and a damper frame 632. In some embodiments, the damper frame extends the height of the ammunition slot 624. For example, a damper frame may coat the entire inside of an ammunition slot, providing padding through the entire ammunition slot.

Figure 7:
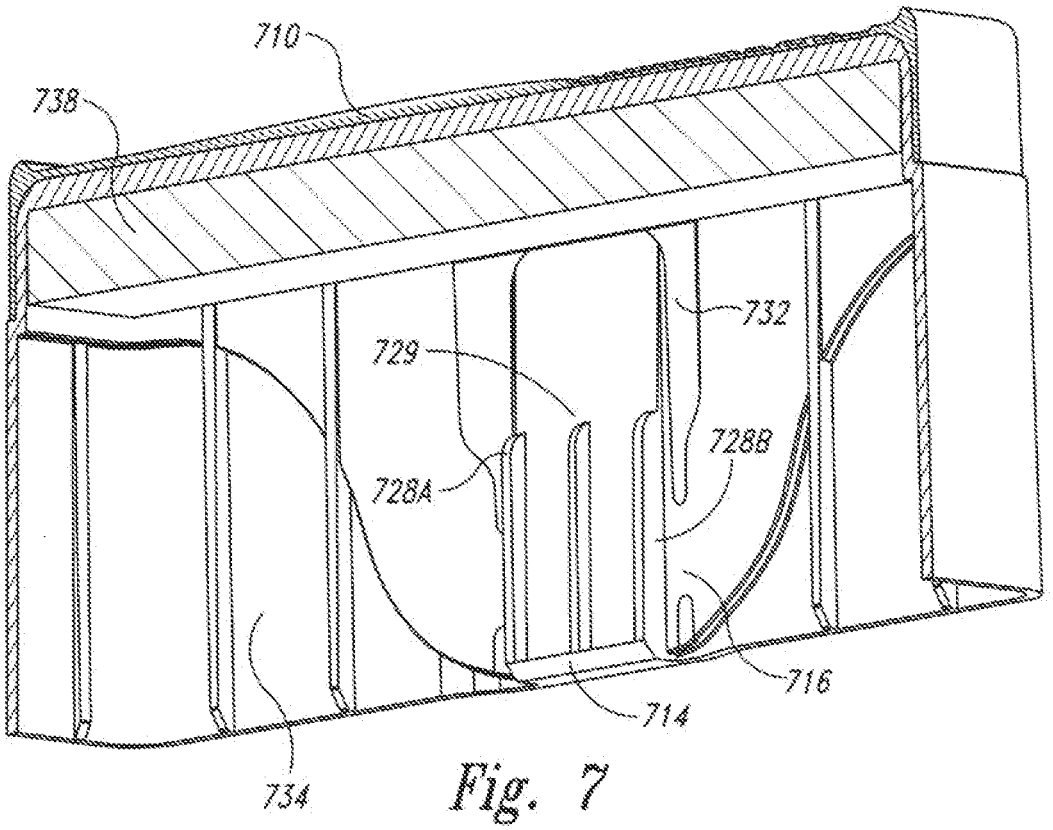
FIG. 7 is a cross-sectional isometric view of a first member of an ammunition storage container.

FIG. 7 is a cross-sectional isometric view of a first member 710 of an ammunition storage container, showing an interior portion of the first member 710. The inside portion of the first member 110 depicted in FIG. 1 may be configured like the inside portion of the first member 710. The first member includes a lever 716, a body 734, and a connector 732. The lever 716 of the first member 710 includes a first outer detent 728A, a second outer detent 728B, and a center detent 729. The first outer detent 728A and the second outer detent 728B are configured to slide beside a set of teeth of a second member when the first member 710 is slid over the second member. Similarly, the center detent 729 is configured to slide in a lever space of the second member. A catch 714 is configured on an end of the lever 716. The lever 716 is configured such that applying pressure to the top of the lever when the first and second members are secured together creates a fulcrum on the lever where it and/or the detents 728-729 contact the second member. This action releases the catch 714 from a reciprocal engagement component of the second member (e.g., a set of teeth).

In large part, the first member 710 and the lever 716 may be composed of a rigid material, such as a hard plastic, a wood, a metal, or the like. The connector 732, however, that connects the lever 716 with the body 734, may be composed of a bendable material that is both firm enough to hold the lever taunt so that the catch 714 of the lever 716 contacts a set of teeth of a second member 720 when the first member is slid over the second member, and pliable enough to allow the lever to move about its fulcrum when pressure is applied to the top of the lever 716. In some embodiments, the connector 732 is composed of rubber. In some embodiments, a first member does not include a connector, but rather includes a spring system that keeps the lever taunt but allows the lever to disengage with a set of teeth when pressure is applied to the pressure point. In some embodiments, the lever of the first member includes a hinge that connects the lever 716 with the body 734. The lever may rotate about the hinge when pressure is applied to the catch 714 or to the pressure point.

In some embodiments, a padding 738 is configured in the first member 710. The padding may be a foam, a rubber, or the like. The padding 738 may contact ammunition stored by an ammunition storage container to prevent the ammunition from rattling and becoming damaged.

From the foregoing, it will be appreciated that specific embodiments of the invention have been described herein for purposes of illustration, but that various modifications may be made without deviating from the invention. For example, the storage container may be configured to store objects other than ammunition. Furthermore, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A container for holding ammunition, the container comprising:

a first member having an interior portion; and a second member having a top portion and configured to be releasably received in the interior portion of the first member, wherein;

the second member includes a plurality of ammunition slots that open to the top portion of the second member, the first member includes a first element of a securing device;

the first element of the securing device includes a lever and a pressure point;

the second member includes a second element of the securing device;

the securing device is configured to releasably secure the first member relative to the second member after the top portion of the second member is received in the interior portion of the first member; and the lever being pivotable about a fulcrum at a contact between the first member and the second member below a top of the second member to release the securing device when pressure is exerted on the pressure point and the first member is releasably secured to the second member.

2. The container of claim 1, wherein:

the first element of the securing device comprises at least one of an engagement component and a reciprocal engagement component;

the second element of the securing device comprises the other of said at least one of the engagement component and the reciprocal engagement component; and the securing device is releasably secured when the engagement component engages the reciprocal engagement component.

3. The container of claim 2, wherein:

the lever is configured to release the engagement component from the reciprocal engagement component when pressure is exerted on the pressure point.

4. The container of claim 2, wherein:

the engagement component is a catch, the reciprocal engagement component is a set of teeth, and the lever is configured to release the catch from the set of teeth when pressure is exerted on the pressure point.

5. The container of claim 1, wherein the ammunition slots are configured such that ammunition placed within the slots are prevented from touching one another.

6. The container of claim 1, further comprising a plurality of dampers and/or damper frames configured in the slots.

7. The container of claim 2, wherein the at least one reciprocal engagement component comprises a hole.

8. The container of claim 2, wherein the engagement component is engageable with the reciprocal engagement component at multiple locations on the reciprocal engagement component for releasably securing the first member relative to the second member at different positions of the first member with respect to the second member.

9. The container of claim 2, further comprising a padding between the top of the second member and the interior portion of the first member.

10. The container of claim 1, further comprising a padding between the top of the second member and the interior portion of the first member.

11. An apparatus for storing ammunition including a first member and a second member, the apparatus comprising:

means for compartmentalizing ammunition in the second member; and means for single handedly releasably securing the first member to the second member when the first member is placed on the second member and the first member is pushed down relative to the second member beyond an engagement point, wherein the means for single handedly releasably securing the first member to the second member includes a lever and a fulcrum about which the lever pivots to release the releasable securing of the first member to the second member, the fulcrum being created at a contact between the first member and the second member when pressure is exerted on a pressure point, wherein the means for single handedly releasably securing the first member to the second member includes an engagement component and a reciprocal engagement component, the engagement component being engageable with the reciprocal engagement component at multiple locations on the reciprocal engagement component for releasably securing the first member relative to the second member at different positions of the first member with respect to the second member.

12. The apparatus of claim 11, wherein the means for compartmentalizing ammunition includes means for padding its contents.

13. The container of claim 11, wherein the fulcrum contacts a side of the second member below a top of the second member when pressure is exerted on the pressure point and the first member is releasably secured to the second member.

14. A container comprising:

a first member having an interior portion; and a second member having a top section including a top upward facing surface, the second member being configured so that the top section may enter the interior portion of the first member, wherein:

the second member includes at least one slot that opens to the top section of the second member, the first member includes a first element of a securing device, wherein the first element of the securing device includes a pressure point;

the second member includes a second element of the securing device;

the securing device is configured to releasably secure the first member on the second member after the first member has been positioned relative to the second member beyond an engagement point, and a portion of the first member being pivotable about a fulcrum to release the securing device, the fulcrum contacting the second member below said top upward facing surface when pressure is exerted on the pressure point and the first member has been positioned relative to the second member beyond the engagement point.

15. The container of claim 14, wherein:

the first element of the securing device comprises at least one of an engagement component and a reciprocal engagement component;

the second element of the securing device comprises the other of said at least one of the engagement component and the reciprocal engagement component; and the securing device is configured to be releasably secured when the engagement component engages the reciprocal engagement component.

16. The container of claim 15, wherein:

the first element of the securing device further comprises a lever, and the lever is configured to release the engagement component from the reciprocal engagement component when pressure is exerted on the pressure point.

17. The container of claim 15, wherein:

the first element of the securing device further comprises a lever, the engagement component is a catch, the reciprocal engagement component is a set of teeth, and the lever is configured to release the catch from the set of teeth when pressure is exerted on the pressure point.

18. The container of claim 15, wherein the at least one reciprocal engagement component comprises a hole.

19. The container of claim 15, wherein the engagement component is engageable with the reciprocal engagement component at multiple locations on the reciprocal engagement component for releasably securing the first member relative to the second member at different positions of the first member with respect to the second member.

20. A container for holding ammunition, the container comprising:

a first member having an interior portion; and a second member having a top portion and configured to be releasably received in the interior portion of the first member, wherein;

the second member includes a plurality of ammunition slots that open to the top portion of the second member, the first member includes a first element of a securing device;

the first element of the securing device includes a lever and a pressure point;

the second member includes a second element of the securing device;

the securing device is configured to releasably secure the first member relative to the second member after the top portion of the second member is received in the interior portion of the first member;

the lever being pivotable about a fulcrum at a contact between the first member and the second member to release the securing device when pressure is exerted on the pressure point and the first member is releasably secured to the second member;

the first element of the securing device comprises at least one of an engagement component and a reciprocal engagement component;

the second element of the securing device comprises the other of said at least one of the engagement component and the reciprocal engagement component;

the securing device is releasably secured when the engagement component engages the reciprocal engagement component;

the engagement component is a catch;

the reciprocal engagement component is a set of teeth; and the lever is configured to release the catch from the set of teeth when pressure is exerted on the pressure point.

21. A container for holding ammunition, the container comprising:

a first member having an interior portion; and a second member having a top portion and configured to be releasably received in the interior portion of the first member, wherein;

the second member includes a plurality of ammunition slots that open to the top portion of the second member, the first member includes a first element of a securing device;

the first element of the securing device includes a lever and a pressure point;

the second member includes a second element of the securing device;

the securing device is configured to releasably secure the first member relative to the second member after the top portion of the second member is received in the interior portion of the first member;

the lever being pivotable about a fulcrum at a contact between the first member and the second member to release the securing device when pressure is exerted on the pressure point and the first member is releasably secured to the second member;

the first element of the securing device comprises at least one of an engagement component and a reciprocal engagement component;

the second element of the securing device comprises the other of said at least one of the engagement component and the reciprocal engagement component;

the securing device is releasably secured when the engagement component engages the reciprocal engagement component; and the at least one reciprocal engagement component comprises a hole.

22. A container for holding ammunition, the container comprising:

a first member having an interior portion; and a second member having a top portion and configured to be releasably received in the interior portion of the first member, wherein;

the second member includes a plurality of ammunition slots that open to the top portion of the second member, the first member includes a first element of a securing device;

the first element of the securing device includes a lever and a pressure point;

the second member includes a second element of the securing device;

the securing device is configured to releasably secure the first member relative to the second member after the top portion of the second member is received in the interior portion of the first member;

the lever being pivotable about a fulcrum at a contact between the first member and the second member to release the securing device when pressure is exerted on the pressure point and the first member is releasably secured to the second member;

the first element of the securing device comprises at least one of an engagement component and a reciprocal engagement component;

the second element of the securing device comprises the other of said at least one of the engagement component and the reciprocal engagement component;

the securing device is releasably secured when the engagement component engages the reciprocal engagement component;

the engagement component is engageable with the reciprocal engagement component at multiple locations on the reciprocal engagement component for releasably securing the first member relative to the second member at different positions of the first member with respect to the second member.

* * * * *